US006012952A

United States Patent [19]

Choy et al.

[11] Patent Number: 6,012,952

[45] Date of Patent: Jan. 11, 2000

[54] SLANTED CONNECTOR

[75] Inventors: Edmond Choy, Union City; Jenq-Yih Hwang, Milpitas, both of Calif.

[73] Assignee: Hon Hai Precision Ind. Co., Ltd., Taipei Hsien, Taiwan

[21] Appl. No.: 08/910,376

[22] Filed: Aug. 13, 1997

[51] Int. Cl.[7] ..... H01R 23/70

[52] U.S. Cl. ..... 439/637

[58] Field of Search ..... 439/637, 326; 29/842, 844, 876

[56] References Cited

U.S. PATENT DOCUMENTS

| | | | |
|---|---|---|---|
| 5,511,985 | 4/1996 | Noschese et al. | 439/157 |
| 5,562,461 | 10/1996 | Obara et al. | 439/62 |
| 5,567,171 | 10/1996 | Mizuguchi | 439/326 |
| 5,641,295 | 6/1997 | Koyama | 439/326 |

*Primary Examiner*—Steven L. Stephan
*Assistant Examiner*—J. F. Duverne

[57] ABSTRACT

A slanted card edge connector (10) includes an insulative housing (12) defining a central slot (14) for receiving a card therein wherein two rows of passageways (30, 32) are disposed by two sides of the central slot (14) for respectively receiving the corresponding contacts (34, 36) therein. The lower row contacts (36) are installed within the corresponding passageways (32) from the front side of the housing (12), and the upper row contacts (34) are installed within the corresponding passageways (30) from the rear side, respectively. Three wedge like supports (20) are provided under two opposite ends and the middle portion (22) of the housing (12) so as to result in the central slot (14) extending upward and forward along a predetermined upward angle, thus resulting in a significant distance between the surface of the PC board (100), on which the connector (10) is seated, and the corresponding lower row passageway (32). In comparison with the upper row passageway (30), the lower row passageway (32) further includes an extending slit (66) intermediating between the front opening (62) and the contact channel (64) so that the contact section (68) of the lower row contact (36) can be inserted into the corresponding lower row passageway (32) from the front side under the condition that the contact section (68) of the contact (36) may pass the front opening (62), the slit (66) and the contact channel (64). Then, eventually the contact section (68) of the lower row contact (36) can extend into the central slot (14) with a preloaded status.

12 Claims, 9 Drawing Sheets

SLANTED CONNECTOR

BACKGROUND OF THE INVENTION

1. Field of the Invention

The invention relates to electrical connectors for use with cards, and particularly to the slanted card edge connector having a slanted housing with two rows of contacts positioned by two sides of the upward forward extending central slot of the housing wherein the upper row contacts are inserted into the housing from the back and the lower contacts are inserted into the housing from the front.

2. The Related Art

U.S. Pat. No. 5,511,985 discloses slanted DIMM (Dual In-line Memory Module) connectors each having a plurality of rows of contacts with vertically extending contact tails each for engagement within a through hole in the PC board on which the connectors are mounted. It is noted that to align the contact tails with the corresponding through holes in the PC board, a keeper section, i.e., the spacer, is used therewith about the rear portion of the housing of the connector. Anyhow, sometimes different PC board manufacturer defines different circuits layout on the PC board wherein the through hole soldering attachment may be replaced by the surface mounting securement, and the circuit pastes are designedly arranged on two sides of the housing of the connector instead of on the rear side of the housing.

An object of the invention is to provide a slanted DIMM connector having two rows of contacts of which the tails are respectively soldered on the corresponding pastes which are respectively located on two sides of the housing.

It is noted that originally, the through hole type slanted DIMM connector and/or the traditional surface mounting type vertical DIMM connector all have their contacts installed from the rear/bottom section of the housing, so that the fabrication and the assembling of the housing and the contacts are generally simple and easy. Differently, under the new situation of the invention that the slanted DIMM connector is required to have such two rows of contact tails respectively mounted on two sides of the housing for solderable engagement with the corresponding solder pastes on the PC board, it is natural that the distal end of the contact tail should confront the corresponding solder paste on the board. Understandably, U.S. Pat. No. 5,641,295 discloses a horizontal type connector assembly wherein the lower connector includes a housing defining a central horizontal slot for receiving a card therein and two rows of contacts are positioned by two sides thereof, and wherein because the corresponding solder pastes are arranged on two sides of the housing and the contacts are all installed from the rear side of the housing, the contact tail of each lower row contact extends to the front side in a U-shaped configuration for attachment with the corresponding solder paste on the front side of the housing. It takes too much material of the lower row contacts and complicates the installation of the lower row contacts to the housing.

Therefore, another object of the invention is to provide a slanted DIMM connector with two rows of contacts wherein the lower row contacts are installed within the housing from the front side of the housing, whereby it is easy to assemble the contact to the housing and avoid wasting material for not extending in a form of U-shaped configuration of each contact tail of the lower row contact.

SUMMARY OF THE INVENTION

According to an aspect of the invention, a slanted card edge connector includes an insulative housing defining a central slot for receiving a card therein wherein two rows of passageways are disposed by two sides of the central slot for respectively receiving the corresponding contacts therein. The lower row contacts are installed within the corresponding passageways from the front side of the housing, and the upper row contacts are installed within the corresponding passageways from the rear side, respectively. Three wedge like supports are provided under two opposite ends and the middle portion of the housing so as to result in the central slot extending upward and forward along a predetermined upward angle, thus resulting in a significant distance between the surface of the PC board, on which the connector is seated, and the corresponding lower row passageway. In comparison with the upper row passageway, the lower row passageway further includes an extending slit intermediating between the front opening and the contact channel so that the contact section of the lower row contact can be inserted into the corresponding lower row passageway from the front side under the condition that the contact section of the contact may pass the front opening, the slit and the contact channel. Then, eventually the contact section of the lower row contact can extend into the central slot with a preloaded status.

Moreover, the contact tails of the lower row contacts and those of the upper row contacts are generally positioned equally by two sides of the housing relative to the common center line defined by the posts extending downward from the housing.

Yet, the invention further includes three fastening devices respectively fastened to the wedge like supports with a mounting pad solderably mounted on the corresponding solder paste.

BRIEF DESCRIPTION OF THE DRAWINGS

FIG. 1(A) is a partially enlarged perspective view of the housing with a wedge like support of FIG. 1.

FIG. 1(B) is a perspective view of the upper row contact of FIG. 1.

FIG. 1(C) is a perspective view of the lower row contact o FIG. 1.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
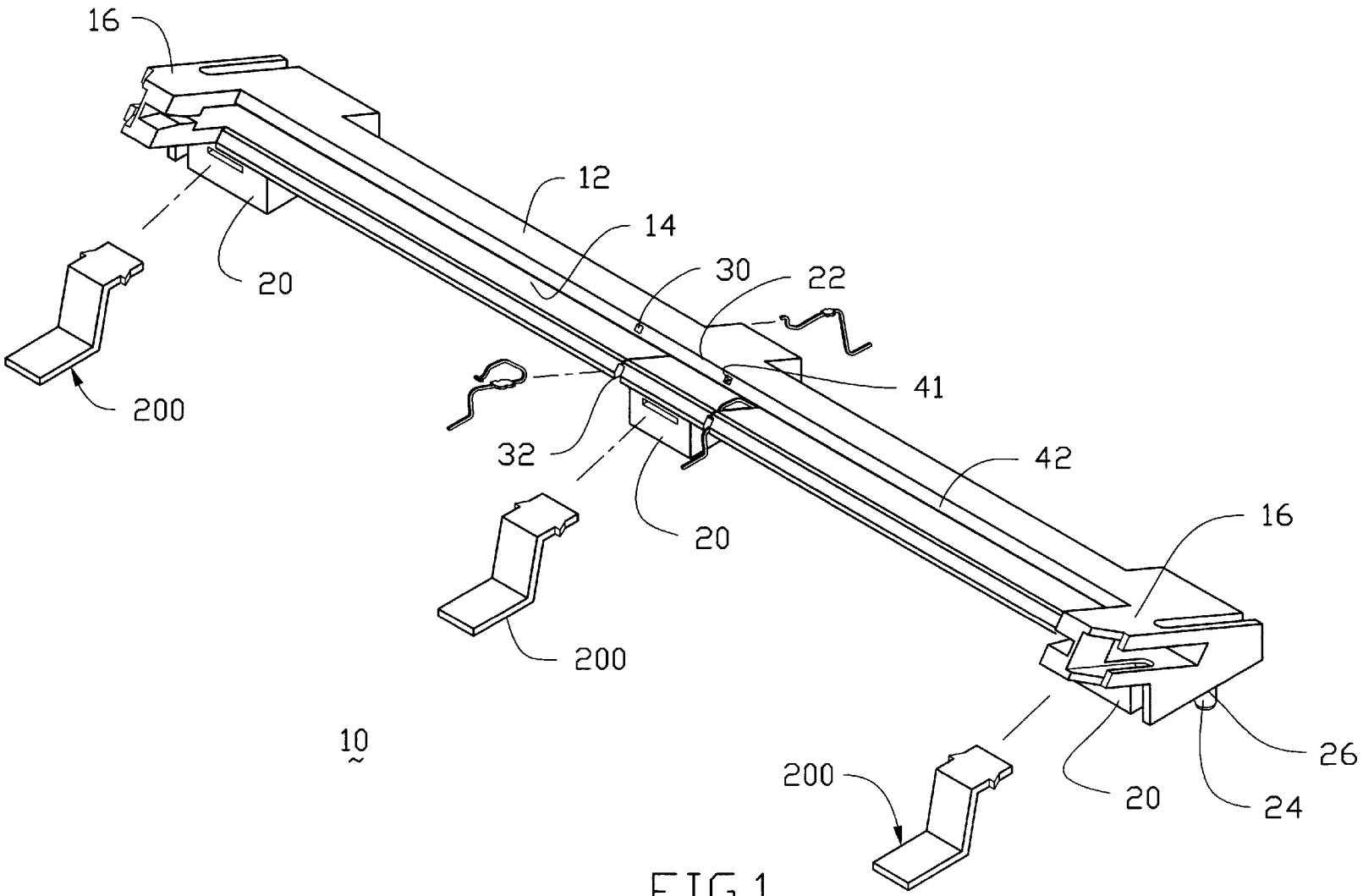
FIG. 1 is an exploded perspective view of a presently preferred embodiment of a slanted DIMM connector without the ejectors thereof, according to the invention.
Figure 1:
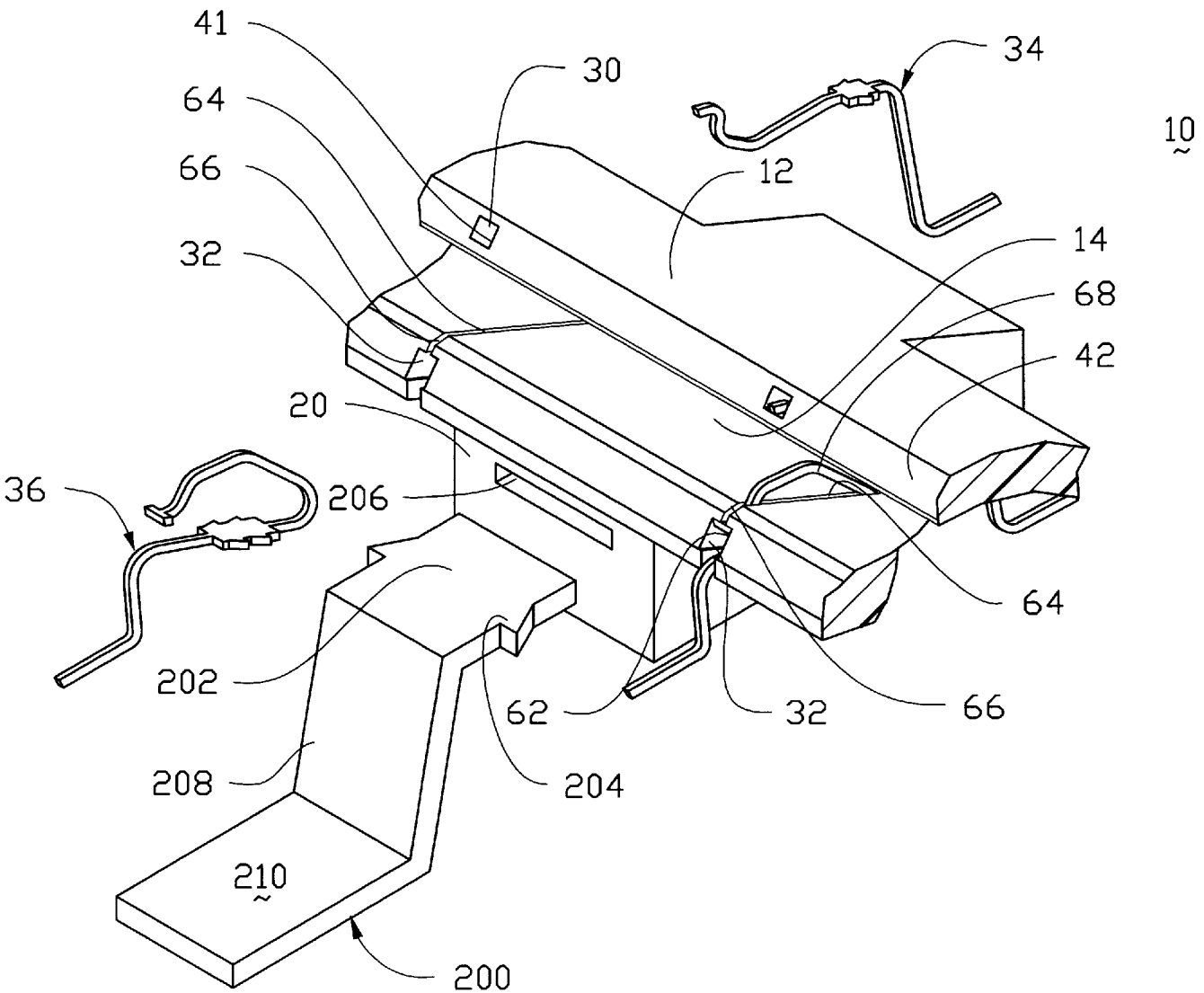
Figure 1:
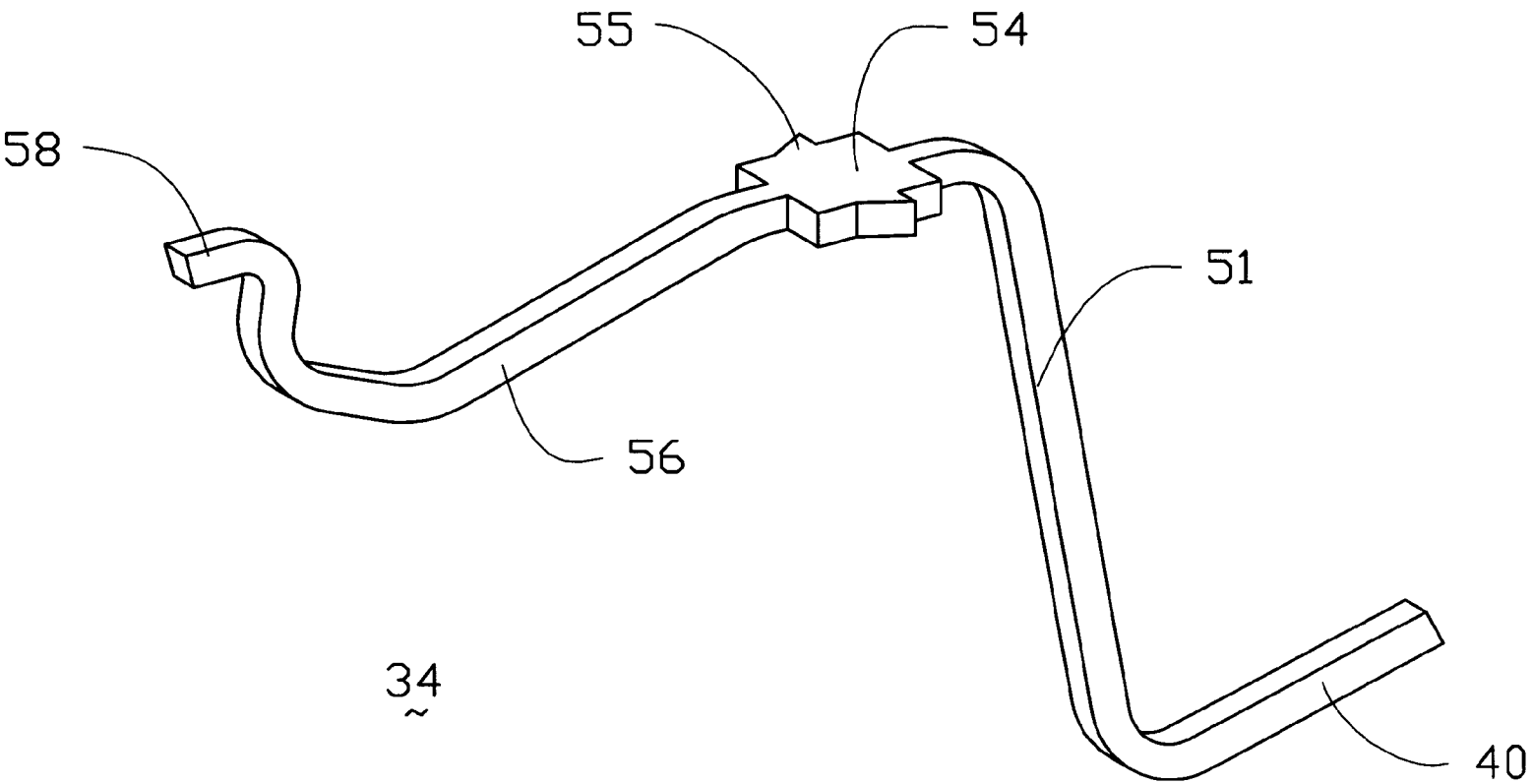
Figure 1:
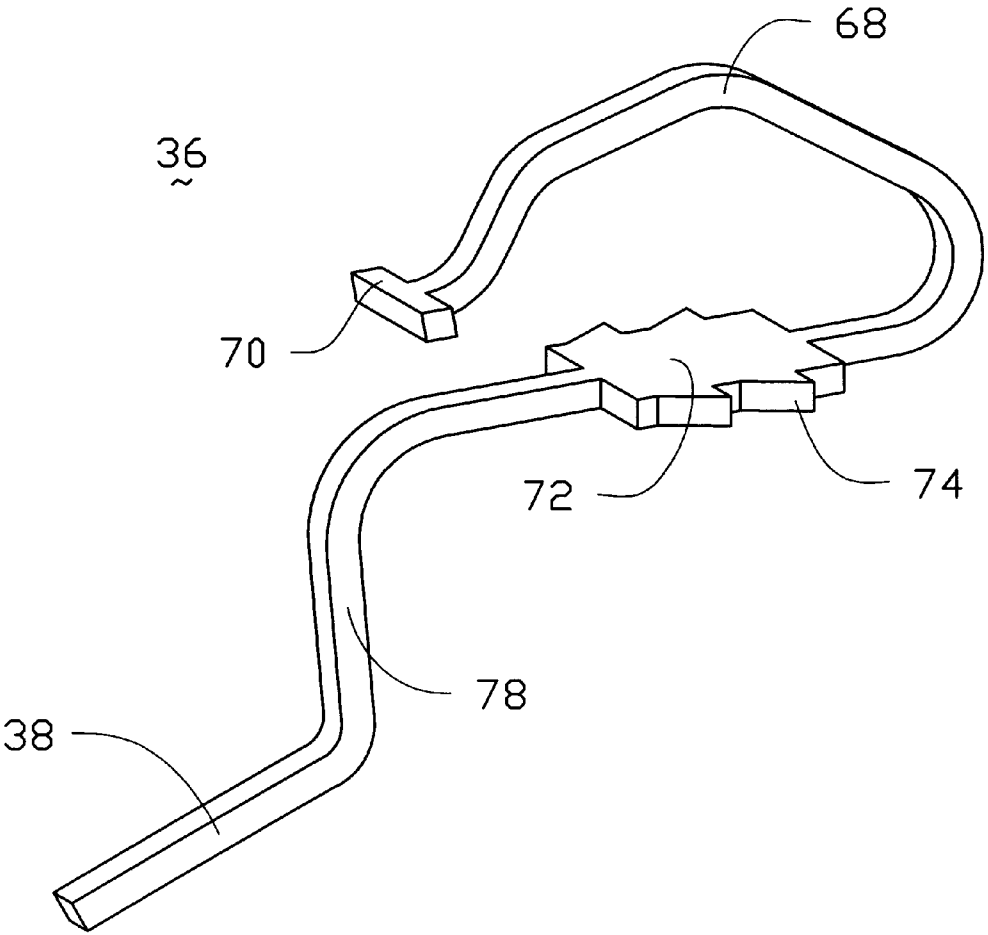
Figure 2:
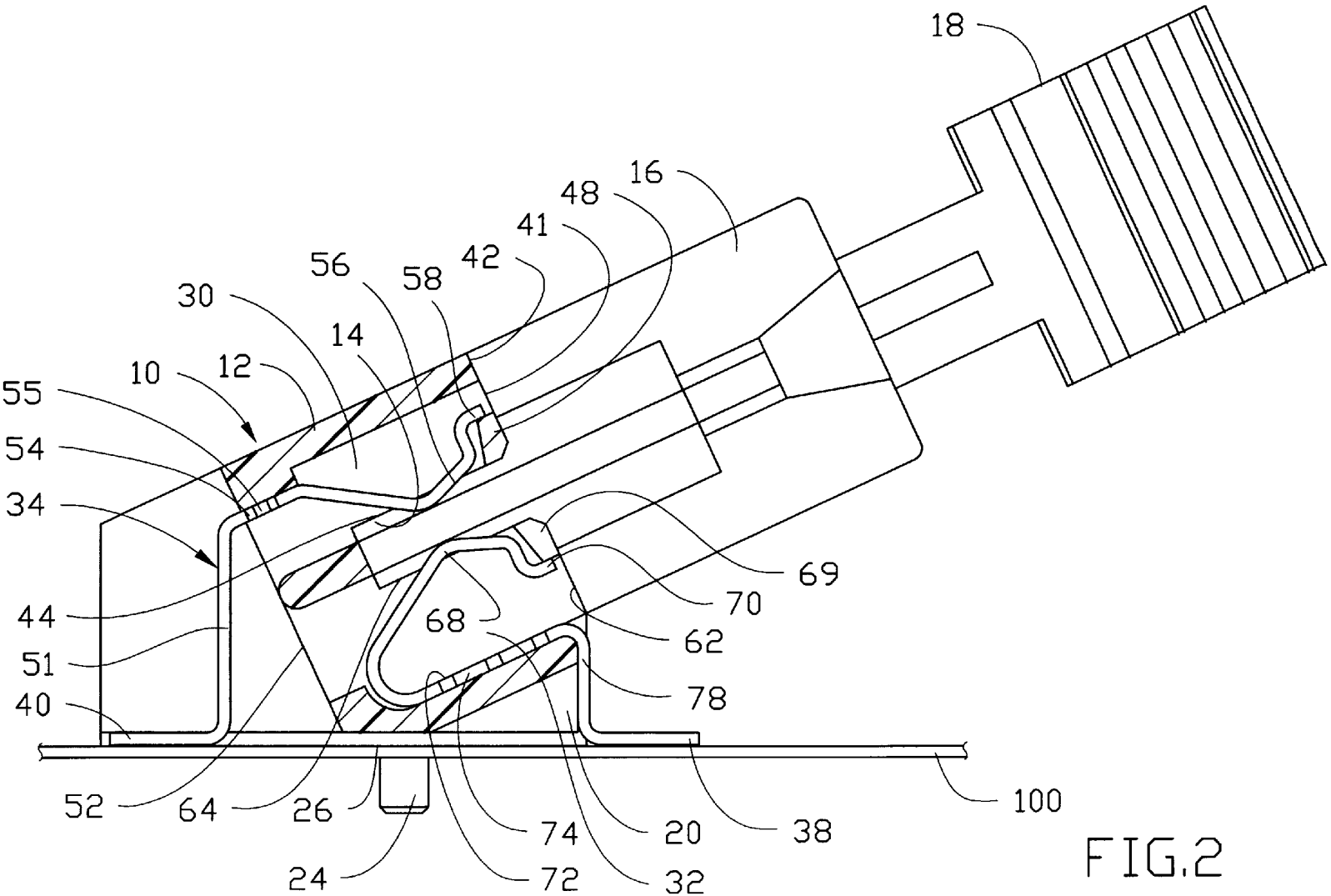
FIG. 2 is a cross-sectional view of the connector of FIG. 1 with the ejector thereof.
Figure 3:
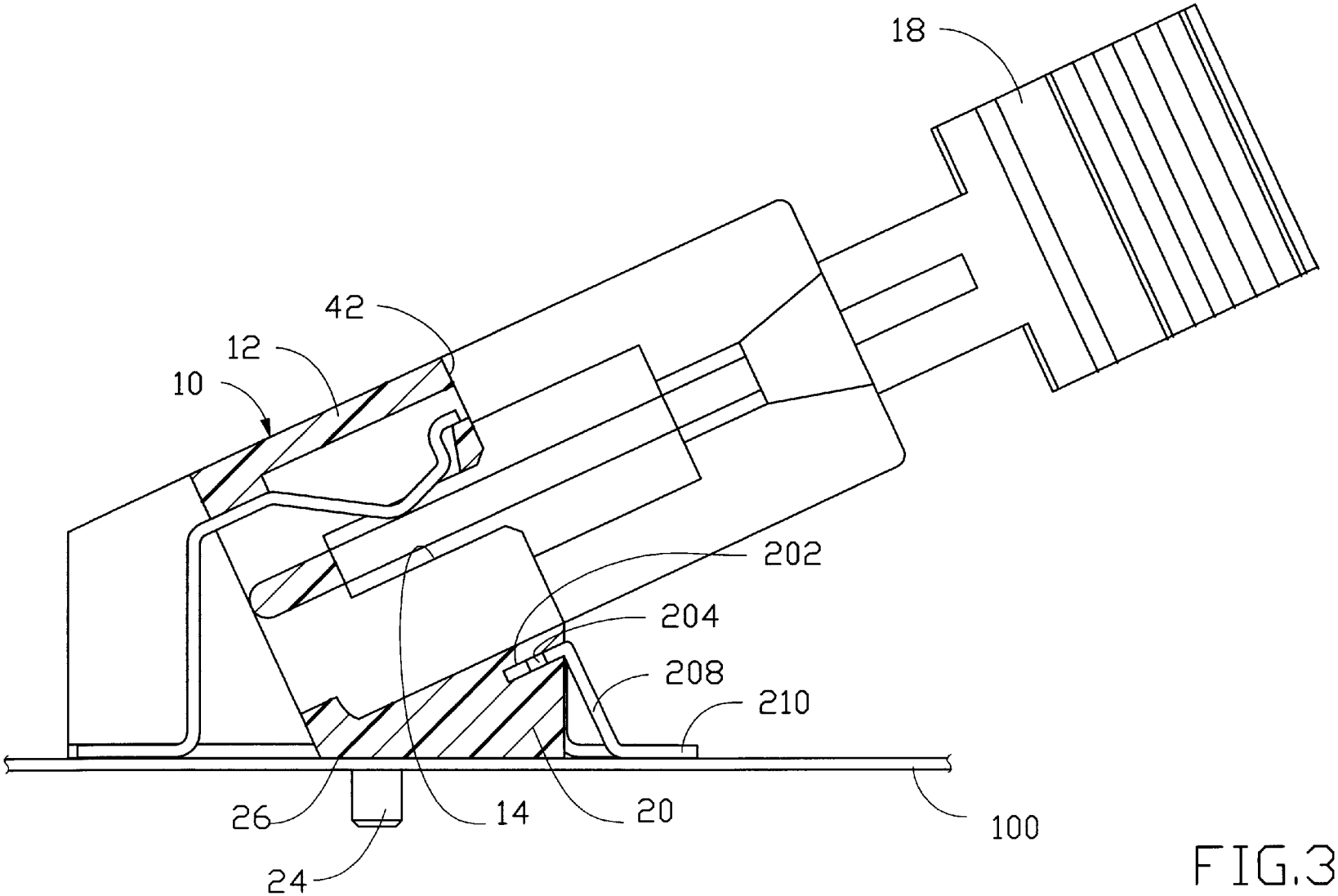
FIG. 3 is another cross-sectional view of the connector of FIG. 1 wherein the lower portion of the housing is cut away along the wedge like support to show the fastening devices thereof.

It will be noted here that for a better understanding, most of like components are designated by like reference numerals throughout the various figures in the embodiments. Attention is directed to FIGS. 1–3 wherein a slanted 25 degrees DIMM connector includes an insulative housing 12 defining a central slot 14 for receiving a DIMM module (not shown) therein. A pair of tower sections 16 are disposed at two opposite ends of the housing 12 for receiving a pair of corresponding ejectors 18 (FIGS. 2 and 3) therein so as to releasably lock the DIMM module in the housing 12.

Three wedge like supports 20 are positioned under the housing 12 adjacent two tower section 16 and the middle portion 22 so that the housing 12 with the associated central slot 14 extends upward in an angular manner. In this embodiment, the degree of the housing 12 with regard to the PC board 100, on which the connector 10 is seated, is twenty-five.

A plurality of upper passageways 30 and lower row passageways 32 are provided on two sides of the central slot 14 for receiving the corresponding number of upper row contacts 34 and lower row contacts 36 therein, respectively.

Figure 4:
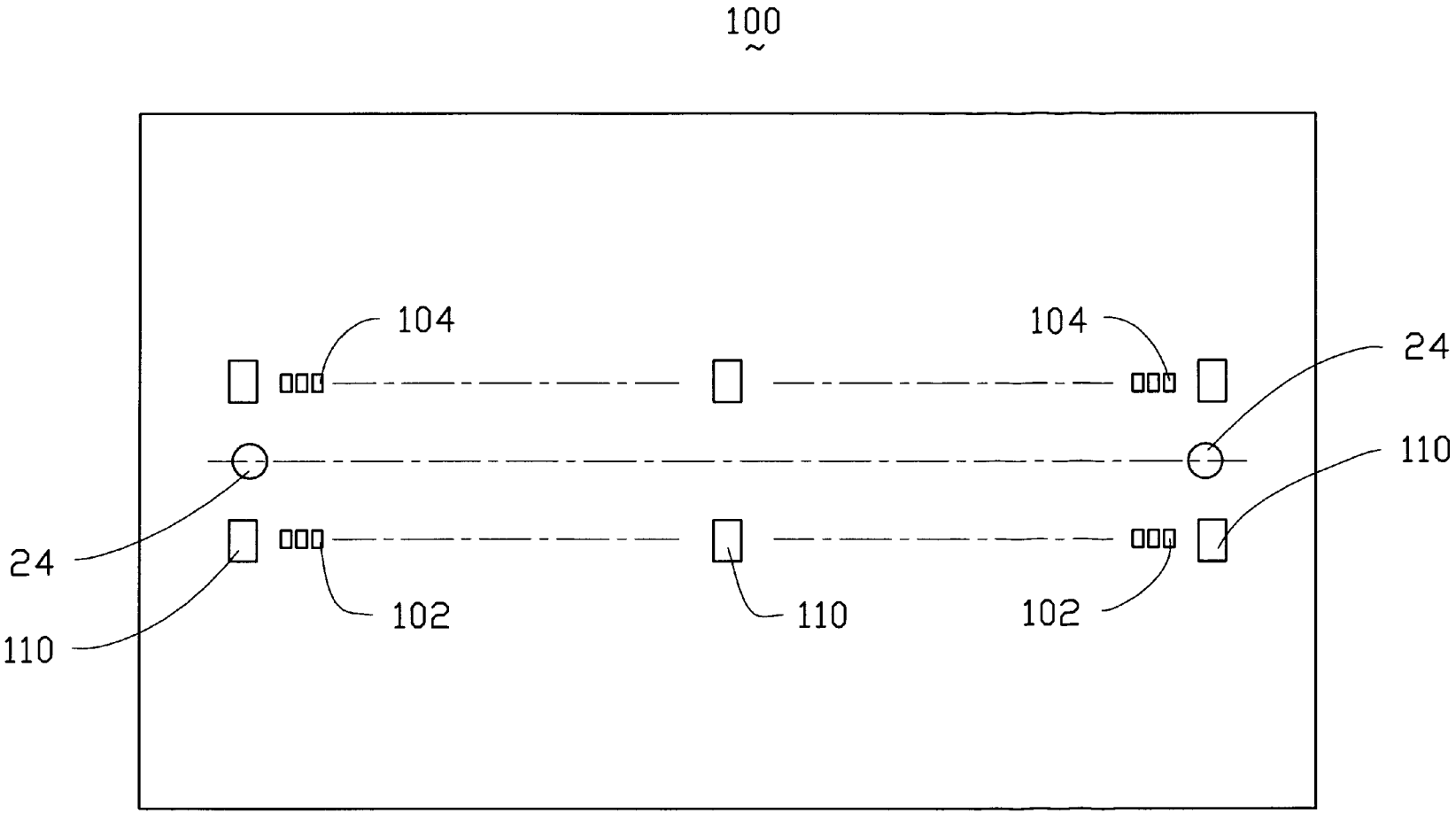
FIG. 4 is a plan view of a layout of the PC board for use with the connector of FIG. 1.

The housing 12 further includes three posts 24 integrally downward extending from the bottom surface 26 (only one shown) for initially retaining the housing 12 on the PC board 100. As shown in FIG. 4, because to efficiently use the space of the PC board 100, the contact traces/pastes 102, 104 are symmetrically arranged by two sides of the common center line of the posts 24. Accordingly, based on a reasonable engineering configuration, the distal ends 38 of the lower row contacts 36 designedly confront the corresponding front side pastes 102 and the distal ends 40 of the upper row contacts 34 designedly confront the corresponding rear side pastes 104.

To achieve the aforementioned requirements, the upper row contacts 34 are intentionally installed within the corresponding upper row passageways 30 from the rear, and the lower row contacts 36 are intentionally installed within the corresponding lower row passageways 32 from the front. Thus, the whole assembly is easy to make and saves more material of the contacts 36.

Figure 5:
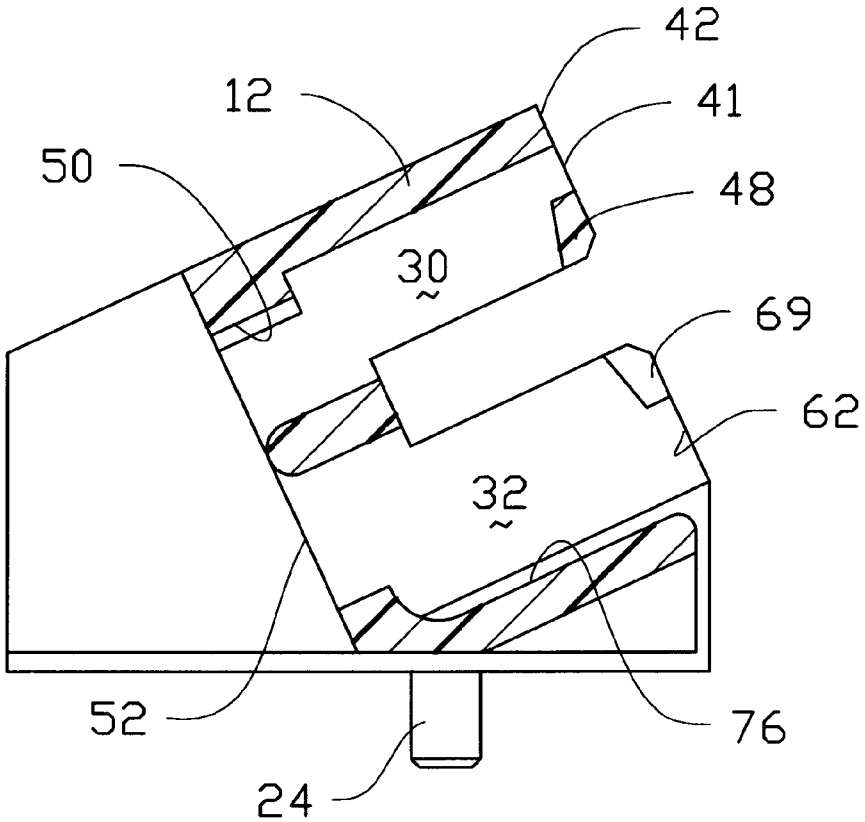
FIG. 5 is a cross-sectional view of the housing of the connector of FIG. 1 without contacts therein.
Figure 6:
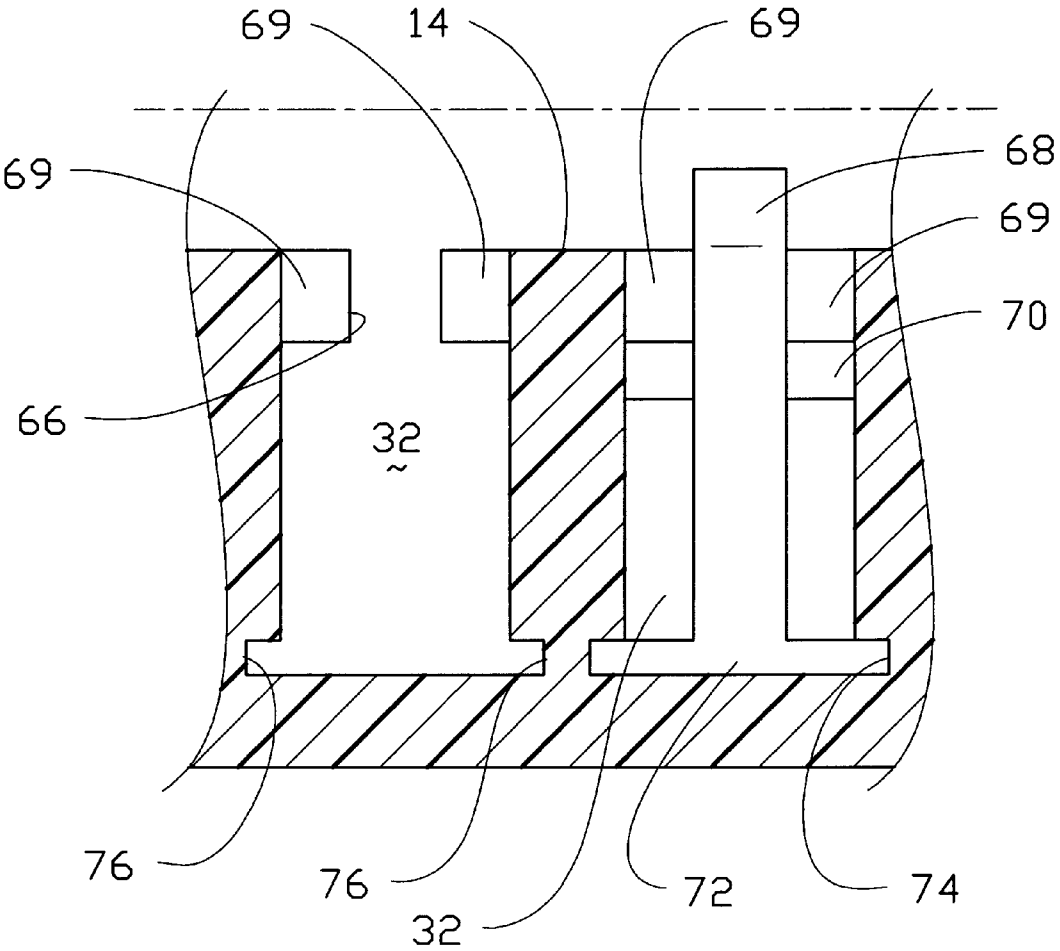
FIG. 6 is a partially enlarged cross-sectional view of the housing around the lower passageway and the corresponding contact.

According to this pattern, referring to FIGS. 2 and 5, each upper row passageway 30 generally includes the similar structure with the traditional DIMM connector regardless of whether it belongs to the vertical type or the slanted type, wherein an front opening 41 is formed on the top surface 42 of the housing 12 and communicative with the passageway 30, and a contact channel 44 is formed on the interior surface 46 of the central slot 14 and also communicative with the passageway 30. An abutment protrusion 48 is formed around the intersection of the contact channel 44 and front opening 41 in the passageway 30. A pair of retention channels 50 (FIG. 5) are provided around the rear portion of the passageway 30 of the housing 12.

Correspondingly, referring to FIGS. 1B and 2, the upper row contact 34 includes a vertical section 51 exposed outside of the rear surface 52 of the housing 12, a retention section 54 extending upward along the same angular manner of the housing 12 with barbs 55 on two sides thereof for interferential engagement with the corresponding retention channel 50, and the contact section 56 extending toward the contact channel 44 and invading the central slot 14 for forcible engagement with the corresponding trace pad on the inserted DIMM module. An engagement tip 58 is provided at the distal end of the contact section 56 for engagement with the abutment protrusion 48 for preloading consideration. In an opposite direction, a horizontal mounting section 40 extends from the rear end of the vertical section 51 for solderably mounting to the corresponding rear side solder paste 104.

Because the lower row contact 36 is designed to be installed within the corresponding lower row passageway 32 from the front side, the lower row passageway 32 and the corresponding lower row contact 36 are configured to have specific contour for implementation of this requirement. Referring to FIGS. 1(C), 2, 5 and 6, similar to the upper passageway 30, a front opening 62 is formed on the top surface 42 of the housing 12 and communicative with the passageway 32, and a contact channel 64 is formed on the interior surface 46 of the central slot 14 and communicative with the passageway 32. Also, an abutment protrusion 69 is formed around the intersection of the front opening 62 and the contact channel 64 for preloading consideration of the corresponding lower row contact 36. Different from the upper passageway 30, an extending slit 66 (FIG. 1(A)) intermediating between the front opening 62 and the contact channel 64 for allowing passage of the contact section 68 of the lower row contact 36 therethrough. In other words, such extending slit 66 extends through the abutment protrusion 69 in comparison with the completely sealed abutment protrusion 48 of the upper row passageway 30.

To comply with the lower row passageway, the lower contact 36 includes the aforementioned contact section 68 angularly extending toward the central slot 14 within the passageway 32 wherein the distal end thereof includes an enlarged head 70 for abutment against the two spaced abutment protrusions 69 in the passageway 32 for preloading consideration. An enlarged retention section 72 reversely extending forward from the rear end of the contact section 68 with barbs 74 interferential engagement within a pair of retention channels 76 (FIG. 5) in the passageway 32. A vertical section 78 integrally extends downward from the front end of the retention section 72 with a mounting section 38 horizontally extending from the bottom end of the vertical section 78.

Based on the foregoing structure, the lower row contact 36 may be inserted into the corresponding lower row passageway 32 from the front wherein the extending slit 66 provides the sufficient space for allowing passage of the contact section 68 of the lower row contact 36.

After assembled, the horizontal mounting sections 40 of the upper row contacts 30 and the horizontal mounting sections 38 of the lower row contacts 32 are designedly solderably mounted unto the corresponding rear side and front side solder pastes 104, 102, respectively.

It can be noted that because the housing 12 is arranged to have a central slot 14 facing upward in an angular status so as to have the upper row and lower row passageways 30, 32 configured in the same direction. Thus, the lower row passageway 32 and the lower row contact 36 comprise the aforementioned features to allow front installation of the lower row contact into the corresponding lower row passageway. It can be appreciated that either the stamping/blanking type contact or the forming/bending type contact may follow the pattern of the structural relationship between the passageway and the contact itself for the slanted housing of the connector as disclosed in the invention.

Referring to FIGS. 1, 1(A) and 3, to reinforce the retention of the connector 10 on the PC board 100, three fastening device 200 are provided adjacent to the corresponding wedge like supports 20 wherein each fastening device 200 includes an inward retaining section 202 with barbs 204 on two sides for interferential engagement within a retention slit 206 in each corresponding wedge like support 20. An intermediate section 208 extends from the outermost end of the retaining section 202 in a direction compliant with the top surface 42 of the housing 12 until it reaches the PC board 100. A mounting ear 210 horizontally forward extends from the bottom end of the intermediate section 208 for solderably mounting to a solder paste 110 on the PA board 100. The configuration of the fastening device 200 may efficiently resist the bending moment imposed upon the housing 10. Similarly, the vertical section 78 of the lower row contact 32 may be reformed to be in a slanted type in compliance with the top surface 42 of the housing 12 for reinforcement of the mounting of the connector 10 on the PC board 100 for the same purpose.

It is also noted that in this embodiment, because the lower row contacts 36 are designedly inserted into the corresponding lower row passageways 32, respectively, the lower row passageway 32 is designed to be substantially larger than the upper row passageway 30 in a lateral direction, i.e., the width of the passageway itself.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A slanted card edge connector mounted above a PC board, comprising:

an insulative housing defining a central slot for receiving a module therein;

upper row passageways and lower row passageways disposed by two sides of said central slot;

a plurality of upper row contacts respectively inserted into the corresponding upper row passageways from a rear side of the housing;

a plurality of lower row contacts respectively inserted into the corresponding lower row passageways from a front side of the housing opposite to said front side;

the central slot extending upward and forward at an angle in a range more than zero degree and less than ninety degrees with respect to the PC board to have the upper and lower row passageways configured in the same direction along said angle; and the lower row contacts inserted into the corresponding lower row passageways from the front side of the housing in an insertion direction along said angle; wherein a first dimension of the upper row passageway is substantially smaller than that of the lower row passageway in a lateral direction perpendicular to said insertion direction.

2. The connector as defined in claim 1, wherein said housing further includes at least one support to provide a height under a bottom portion of the housing and define said angle of the housing so that each of said lower contact includes a height section with a substantial significant distance extending between a horizontal section of said lower row contact and a front opening of the lower row passageway.

3. The connector as defined in claim 2, wherein said section is of a vertical type.

4. The connector as defined in claim 2, wherein an extending slit is formed between said front opening and a contact channel on an interior surface of the central slot.

5. The connector as defined in claim 4, wherein said lower row contact includes an angular contact section adapted to pass the extending slit when the lower row contact is inserted into the lower row passageway from the front side.

6. The connector as defined in claim 2, wherein each of said lower row contacts includes the contact section connected with a reversely forward extending retention section which extends in the same direction along said angle, and said height section is connected to a front end of said retention section, and a horizontal mounting section is connected to a bottom end of the height section.

7. The connector as defined in claim 2, wherein at least a fastening device is attached to said support for solderably mounting to a solder paste on a PC board on which the connector is seated.

8. The connector as defined in claim 7, wherein said fastening device includes a retention section extending in the same direction along said angle, an intermediate section integrally connected to a front end of the retention section in another direction compliant with a top surface of the housing, and a mounting ear horizontally extending forward from a bottom end of the intermediate section.

9. The connector as defined in claim 1, wherein each of said upper row contacts is installed within the corresponding passageway from the rear side of the housing so as to a horizontal mounting section of the upper row contact and another horizontal mounting section of the lower row contact being positioned on two sides of the housing, respectively.

10. An arrangement of a slanted card edge connector, comprising:

an insulative housing extending upward forward in a direction along a predetermined angle within a range between zero degree and ninety degrees with regard to a PC board on which the connector is mounted;

said housing defining a central slot and lower row passageways and upper row passageways by two sides thereof extending in the same direction at said predetermined angle;

a plurality of upper row contacts inserted into the corresponding upper row passageways, respectively, from a rear side of the housing;

a plurality of lower row contacts inserted into the corresponding lower row passageways, respectively, from a front side of the housing; and at least a wedge-like support disposed under a bottom portion of the housing and substantially extending toward both a front side and a rear side of the housing; wherein each pair of the upper row contact and the lower row contact includes respectively a pair of horizontal mounting sections substantially positioned by two sides of the housing.

11. The arrangement as defined in claim 10, wherein said pair of mounting sections are symmetrical with each other with regard to a common center line of posts which both integrally extend downward from a bottom surface of the housing.

12. The arrangement as defined in claim 10, wherein said upper row contacts are inserted into the corresponding upper row passageways from a rear side of the housing, and said lower row contacts are inserted into the corresponding lower row passageways from a front side of the housing.

* * * * *